United States Patent [19]

Popovitch

[11] Patent Number: 4,744,298

[45] Date of Patent: May 17, 1988

[54] SAFING AND ARMING DEVICE AND METHOD

[76] Inventor: Dragolyoub Popovitch, 37 Myers Ave., Denville, N.J. 07834

[21] Appl. No.: 38,967

[22] Filed: Apr. 16, 1987

Related U.S. Application Data

[63] Continuation-in-part of Ser. No. 861,273, May 9, 1986, Pat. No. 4,699,058.

[51] Int. Cl.[4] ..... F42C 15/26

[52] U.S. Cl. ..... 102/235; 102/245; 102/254

[58] Field of Search ..... 102/251, 254, 255, 275, 102/231–233, 237, 238, 244, 245, 221, 222, 241, 243

[56] References Cited

U.S. PATENT DOCUMENTS

| | | | |
|---|---|---|---|
| 1,956,222 | 4/1934 | Methlin | 102/243 |
| 3,603,259 | 9/1971 | Webb | 102/235 |
| 3,780,660 | 12/1973 | Webb et al. | 102/245 |
| 3,882,783 | 5/1975 | Reams | 102/245 |
| 3,886,868 | 6/1975 | Webb | 102/245 |
| 4,242,963 | 1/1981 | Ziemba | 102/240 X |
| 4,432,283 | 2/1984 | Duffner | 102/240 X |

FOREIGN PATENT DOCUMENTS

| | | | |
|---|---|---|---|
| 111123 | 1/1939 | Australia | 102/243 |
| 96201 | 10/1923 | Austria | 102/243 |
| 214641 | 5/1941 | Switzerland | 102/243 |

*Primary Examiner*—David H. Brown

*Attorney, Agent, or Firm*—William J. Ruano

[57] ABSTRACT

A safing and arming device mounted inside the shell of small caliber ammunition for normally forming a barrier between a detonator and an explosive train contained in the shell. A soft wire of lead, aluminum or plastic material, embedded in a groove in the top of the barrier normally holds it against movement. As the result of high spin, the barrier is forced to move so as to open a path between said detonator and explosive train to enable arming after a safe delay. The barrier may be two halves tied together by the soft wire of stretchable material which will slowly stretch as the result of high spin and ultimately break, allowing the halves to move apart radially to open the path. A modification of the barrier is to normally position it eccentrically of the center of gravity, at which location it forms a barrier. High spin will effect cutting of the wire and movement of the barrier to a non-blocking position.

13 Claims, 4 Drawing Sheets

SAFING AND ARMING DEVICE AND METHOD

Continuation-in-part of Application Ser. No. 861,273 filed May 9, 1986, now U.S. Pat. No. 4,699,058.

BACKGROUND OF THE INVENTION

In every kind of explosive ammunition, there is a need for a safing and arming (or S & A) mechanism, the purpose of which is twofold:

to ensure safety in handling, transportation and storage; and to ensure arming after a suitable safety delay following the ejection of the ammunition from its launcher.

One of the main objectives of the present invention is to provide a new method of ensuring the aforementioned safety delay, using either viscous flow or creep as the underlying physical phenomenon.

EXAMPLE A

In a family of mines designed for massive use, the fuze is held in safe position within each mine by a part called "borerider", which, in turn, is locked in safe position by an appropriate shear pin. Thus, no accidental arming can take place during handling, transportation and storage.

For field delivery, the mines are loaded into canisters as shown in FIG. 7. At that time, as each mine is loaded, its borerider B is pressed through an opening in the mine cover, and the borerider shear pin S is broken, but safety is still ensured by the fact that the canister itself keeps the borerider in safe position. Only after the mine is ejected from the canister does it become possible for the borerider to move and for the fuze to arm. Normally, an internal time-delay element permits arming to take place only after the delivery crew has been given enough time to reach safe distance. However, that element occasionally malfunctions and allows arming to take place as soon as the mine leaves the canister. To protect the delivery personnel from that contingency, it has been decided to equip each mine with an additional arming-delay mechanism. That mechanism, hereinafter referred to as the mine fuze timer, is one example of a possible application of the proposed new concept.

EXAMPLE B

In the ammunition for a family of small caliber automatic weapons, the space available for the S & A mechanism is very limited. Due to that limitation, the most practical way to ensure the S & A function is by means of a barrier interrupting the explosive train and held in place by an element which, at the time of firing, gradually deforms and/or ruptures. Such a gradual deformation and/or rupture provides a safe arming delay, and constitutes another example of a possible application of the present invention.

SUMMARY OF THE INVENTION

Example A

The subject mechanism, glued on top of a mine, ensures safety by interlocking with the borerider within the mine via an interlocking pin 1. When the mine is loaded into a canister for delivery, the trigger 5 is pushed into the timer body 9 and its shear pin 6 is broken, but the canister keeps the trigger 5 in safe position. When the mine is ejected out of the canister, the trigger 5 moves under pressure of its spring 7 and retracts its finger 4, thus freeing the timing mechanism to start measuring the appropriate time delay.

Various solutions are proposed to ensure the timing function, but they all lead a delayed movement of a cylindrical element 3 which, via the ball 2 and the interlocking pin 1, frees the borerider within the mine to move to the armed position.

Example B

A barrier, consisting of two halves tied together by means of a soft or stretchable wire or a soft foil strip, is interposed in a channel between the detonator and the rest of the explosive train. At rest, both halves are locked in place by means of setback pins. At the moment of firing, the setback causes both pins to unlock, whereupon the increasing spin causes the connecting wire or foil strip to gradually deform and to rupture, thereby ensuring a safe delay before the two halves are allowed to separate and arm the explosive train.

BRIEF DESCRIPTION OF THE DRAWINGS

Example A

Referring more particularly to the drawings.

Example B

Figure 9:
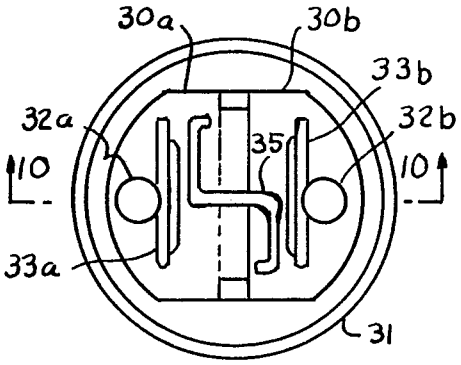
Figure 10:
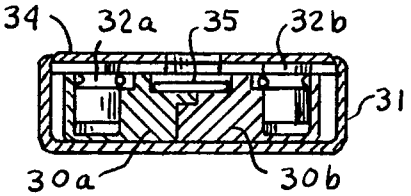
Figure 8:
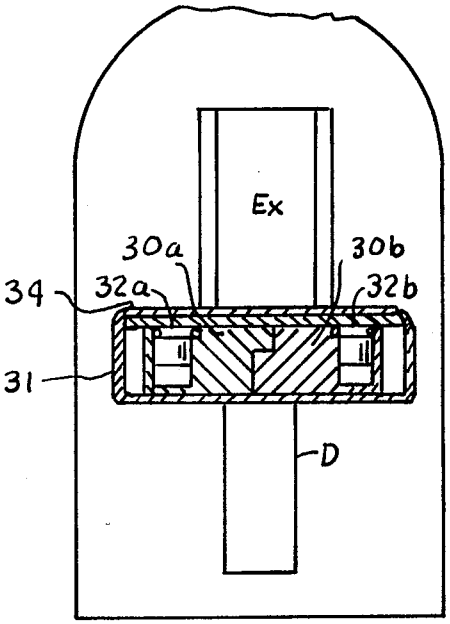
Figure 11:
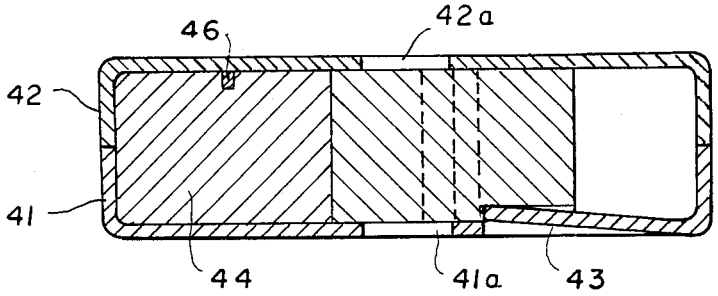
Figure 12:
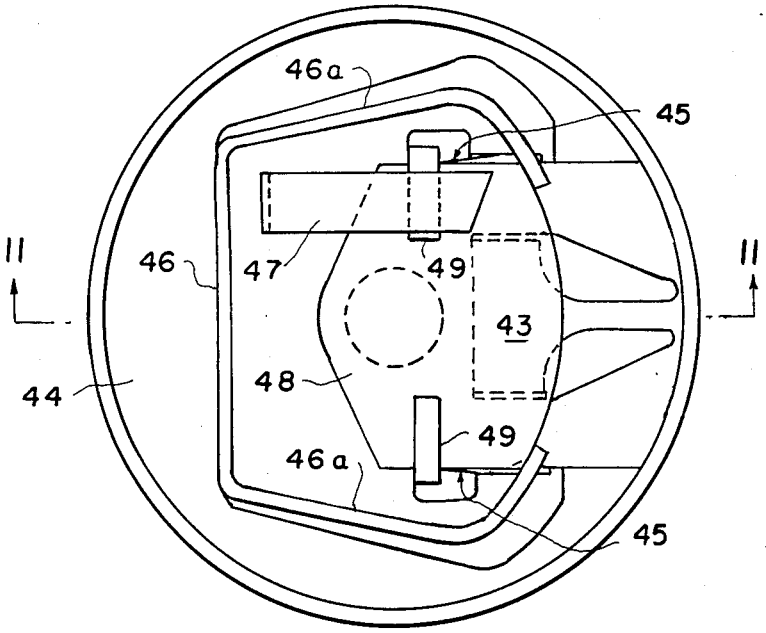
Figure 13:
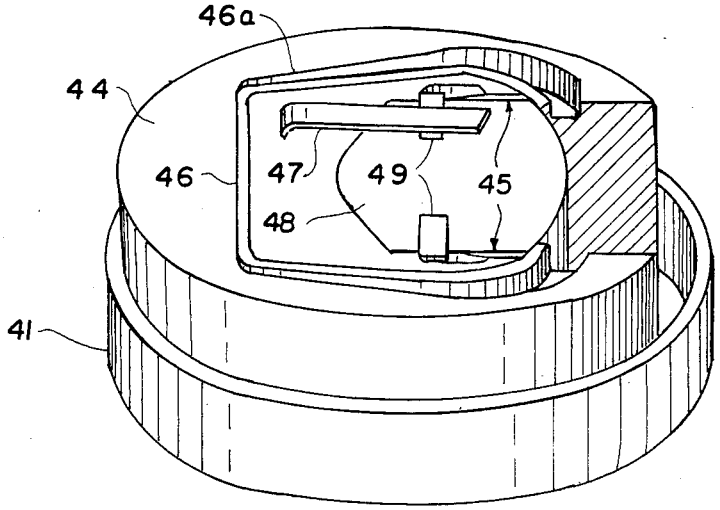

Referring more particularly to the drawings:

FIG. 8 shows a complete assembly of detonator, explosive train, and S & A mechanism for small caliber ammunition;

FIG. 9 is a top view with the cover removed of the S & A mechanism in question; and FIG. 10 is a cross-sectional view of the S & A mechanism taken along line 10—10 of FIG. 9; and FIGS. 11–13 show a modification wherein FIG. 11 is a vertical cross-sectional view taken along line 11—11 of FIG. 12 which shows a top view; and FIG. 13 is a top perspective view.

DESCRIPTION OF THE PREFERRED EMBODIMENTS

Example A

Figure 1:
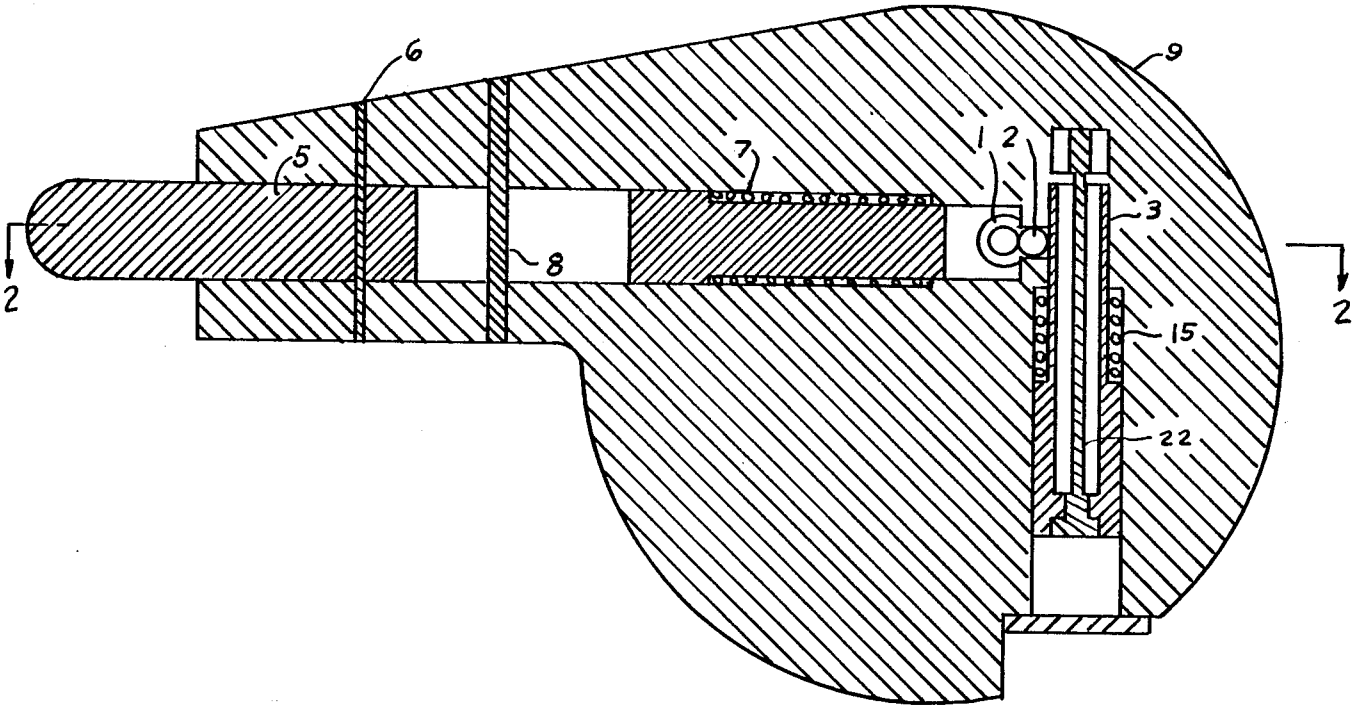
FIG. 1 is a cross-sectional view of the mine fuze timer of the present invention taken along line 1—1 of FIG. 2.
Figures 2, 2A, 3, 4, 5, 6:
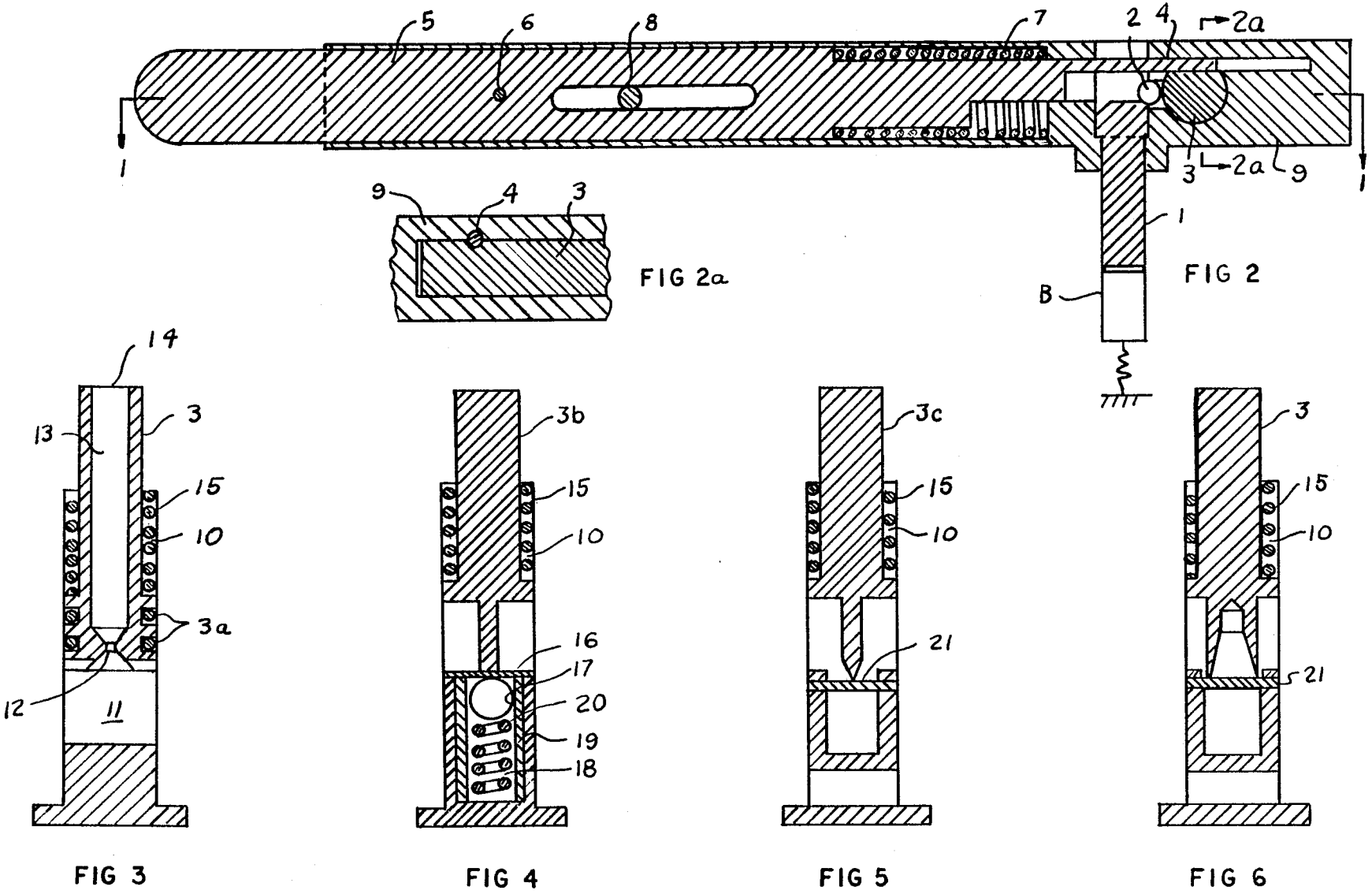
FIG. 2 is a cross-sectional view thereof taken along line 2—2 of FIG. 1
FIG. 2*a* is a cross-sectional view taken along line 2*a*—2*a* of FIG. 2.
FIGS. 3, 4, 5 and 6 are modificators of the timing mechanism.
Figure 7:
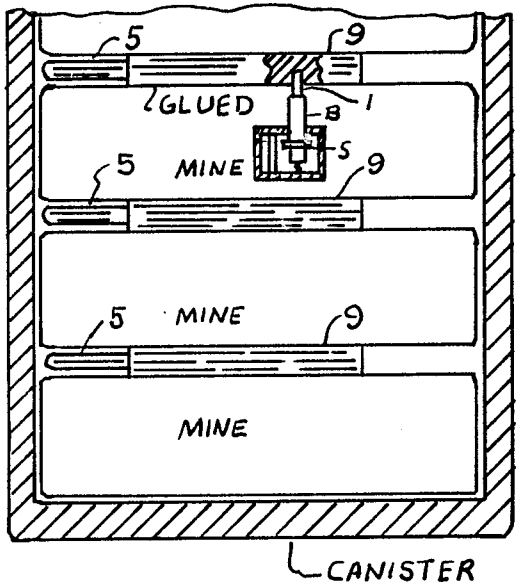
FIG. 7 is a schematic vertical cross-section of entire assembly.

Referring more particularly to FIG. 1 and FIG. 2:

The mine fuze timer is glued on top of the mine (FIG. 7). At that moment, the pin 1 pushes the borerider, which is inside the mine, breaking its locking shear pin. Hence, the borerider spring now pushes the pin 1 which is locked by the locking ball 2 held in safe position by the timing rod 3. The timing rod 3 is locked by a protruding finger 4 of the trigger 5 which is held in safe position by a shear pin 6.

When the mine is loaded into the canister, the trigger 5 is pressed inside the timer body 9 and the shear pin 6 is broken, but the canister holds the trigger 5 in a safe position.

When the mine is ejected from the canister, the trigger 5 moves out, under pressure from the trigger spring 7, and retracts the finger 4, thus freeing the timing rod 3 to start moving against a time measuring mechanism.

The retraction of the trigger 5 is limited by the stop pin 8 and remains inside the housing 9. The timing rod 3 will move until there is no more support for the locking ball 2 which is then cammed out by the pin 1 allowing the borerider, inside the mine, to move and the fuze to arm.

Timing rod 3 is hollow and carries a piece of a creeping material of any shape 22 whose end is fixed to the timer housing 9. When the timing rod 3 is released to move, the material 22 is subjected to a tension and slowly stretches until it is broken or the timing rod 3 has reached the end position and has released the locking ball 2. Again, the time needed for this to happen provides the required time delay.

The properties of a creeping material are much less affected by temperature variations than is the viscosity of used liquid. Also, the use of a creeping material offers a potential for a cost reduction in mass production of the mine fuze timer.

FIG. 3 shows a modification wherein the timing mechanism is a liquid dash-pot. The timing rod 3 is made as a hollow piston with at least one O-ring 3*a* to seal off the cavity 10 and force the liquid 11 to flow through a very precisely calibrated orifice 12. The timing rod cavity 13 is sealed by a seal 14 to prevent the liquid 11 from flowing out during the storage. This seal 14 is broken by the pressure in the liquid 11 which is created when the timing rod 3 starts to move.

The timing rod 3 moves under pressure from the timing spring 15. The acting force of the timing spring 15, the shape of the orifice 12, and the viscosity of the liquid 11 are the parameters which determine the required time delay.

FIG. 4 shows an alternate or modification of the timing mechanisms which operates as follows: The tip of the timing rod 3 a pierces the seal 16 and then pushes the ball 17 forcing the liquid 18 to flow between the ball 17 and the cylinder 19. The spring 20 keeps the ball 17 in the right place during handling and storage.

The tip of the timing rod 3*b* can be blunted as in FIG. 4 or pointed as rod 3*c* and 3*d* in FIGS. 5 and 6, or of any conceivable shape and will cut or shear a wire or a piece of any shape 21 made out of a material which has needed plasticity and will creep when under stress. The time needed to break this piece of such material will provide required time delay. As an example of the material to be used, it can be a readily deformable metal such as lead, tin, etc., or of plastic, or rubber.

Example B

FIGS. 8, 9, and 10 show the construction of a possible S & A mechanism for small caliber ammunition. The barrier consists of two halves 30*a* and 30*b*, which overlap so as to ensure a tight seal between the detonator D and the rest of the explosive train Ex. The base 31 of the housing is shaped so as to present a channel within which the two barrier halves are mounted and can move radially. The two setback pins 32*a* and 32*b* held in safe positions by the spring wires 33*a* and 33*b*, ensure that the two barrier halves are also held in safe positions. The wire 35, made of a soft or stretchable material such as lead, aluminum, tin, or plastic that stretches before rupturing, and mounted within a groove on top of the barrier, also holds the two barrier halves together.

When the ammunition is fired, the high setback causes the two setback pins 32*a* and 32*b* to push their way past the two spring wires 33*a* and 33*b*, thus disengaging from the cover 34 and thereby leaving only the soft wire 35 to hold the two barrier halves 30*a* and 30*b* together. The subsequent high spin with the resultant centrifugal forces pulling the two barrier halves apart, causes the soft wire 35 to stretch and eventually to rupture, thus leading to arming after a safe delay ensured by creep-stretching of the wire 35. Wire 35 may be of other shapes, such as "U"–"Z" so long as the extremities of such shape are locked in place and the intermediate portion is allowed to stretch and then break after a predetermined time.

The proposed S&A device, shown in FIGS. 8–10 and in the modification thereof in FIGS. 11, 12 and 13, is an integral part of a small-caliber explosive shell fired at high velocity from a rapid-fire internally-rifled gun. As such, the device is exposed, at firing, to a combination of high setback and of high spin. The device is interposed between the detonator and the explosive charge within the shell as shown in FIG. 8, and its purpose is twofold: 1. To ensure that, in the absence of the proper combination of setback and of spin, the passage between the detonator and the explosive charge is blocked, so that the shell may not explode even if the detonator is accidentally activated. 2. To ensure that, in the presence of the proper combination of setback and of spin, and after a proper safety delay, the passage between the detonator and the explosive charge is unblocked, so that the shell is armed to explode when the detonator is legitimately activated upon reaching the target.

FIGS. 11, 12 and 13 show a modification of the device shown in FIGS. 8–10. A housing base 41 and a housing cover 42 have holes 41*a* and 42*a*, respectively, at their respective centers (along their common axis), to permit the passage of the flame from the detonator (below the base) to the explosive charge (above the cover). The setback-sensitive leaf spring 43 consists of a slightly raised cut-out portion of the housing base. The S&A carrier block 44 contains all the necessary cavities for the moving parts of the mechanism. The two cutting blades 45 are firmly glued to the sides of an opening extending less than 180° in the carrier block. The spin detent 46 comprises a two-pronged leaf spring mounted within an appropriately shaped cavity in the carrier block. The locking leaf spring 47 is also connected to the carrier block. The barrier 48 has its center of mass located eccentrically with respect to the axis of the overall device, and normally blocks the passage of the detonator flame. The two fingers 49 are made of soft material, such as lead, aluminum, tin or plastic, mounted within the barrier just in front of the two cutting blades 45.

The device, in its passive or blocking configuration, appears as shown in FIGS. 11, 12 and 13.

At firing, the following sequence of events takes place:

The setback-sensitive leaf spring 43, under influence of high initial setback, drops into the cut-out cavity or notch within the housing base 41, thereby disengaging and unlocking the barrier 48. Under influence of high spin which follows, the two prongs 46*a* of the spin detent 46 spread out, thus, in their turn, disengaging the barrier 48. With both the setback-sensitive and the spin-sensitive restraints out of the way, the barrier 48, with its off-center mass, driven by the spin, starts to move radially outwardly and proceeds to lock the setback-sensitive leaf spring 43 in its disengaged position. At that point, the two fingers 49 begin to press against the cutting edges of the two blades 45, thereby slowing down the radial movement of the barrier. The cutting process goes on, thus ensuring the required safety delay, until both fingers are sheared off. Finally free, the barrier 48 rapidly accelerates in its radially outward motion and clears the holes 41*a* and 42*a* in the S&A housing, thus completing the arming process. The locking leaf spring 47 snaps down behind the barrier, in order to make sure that the barrier stays in its armed position.

While I have illustrated and described several embodiments of my invention, it will be understood that these are by way of illustration only and that various changes and modifications may be contemplated in my invention and within the scope of the following claims:

I claim:

1. Safing and arming means for mounting inside the shell of small caliber ammunition for normally forming a barrier between a detonator and an explosive train contained in said shell, said barrier comprising two halves held together by a wire of soft stretchable material which will slowly stretch and ultimately break, allowing said halves to move apart radially as the result of high spin and resulting centrifugal forces, enabling arming after a safe delay.

2. Safing and arming means recited in claim 1 wherein said wire is of a group consisting of lead, aluminum, tin or plastic.

3. Safing and arming means recited in claim 1 wherein said halves are normally held in safe position by a pair of setback pins which, in turn, are held by spring wires.

4. Safing and arming means as recited in claim 3 wherein said wire of soft stretchable material is of S-shape and is seated in a correspondingly shaped groove on top of said halves.

5. Safing and arming means as recited by claim 1 wherein each of said setback pins has a groove through which said spring wire extends.

6. Safing and arming means for mounting inside the shell of small caliber ammunition for normally forming a barrier between a detonator and an explosive train contained in said shell, a set of two fingers normally holding said barrier against movement, said barrier being radially moveable as the result of high spin, and means for severing said two fingers as a consequence of high spin to enable arming after a safe delay.

7. Apparatus as recited in claim 6 wherein said fingers are of a material of the group consisting of lead, aluminum, tin and plastic, and are supported in grooves in said radially moveable barrier.

8. Apparatus as recited in claim 7 together with spin detent resilient means normally engaging said moveable barrier to restrain it from radially outward movement and being responsive to a predetermined spin sufficiently to disengage said moveable barrier and allow free radial movement thereof.

9. Apparatus as recited in claim 8 in which said spin detent means comprises a substantially U-shaped resilient leaf spring with inwardly turned extremities which normally engage the outer surface of said moveable barrier, which resilient leaf spring will disengage the moveable barrier as a consequence of spin, said spring being fitted in a correspondingly shaped groove formed on top of said moveable barrier.

10. Safting and arming means for mounting inside the shell of small caliber ammunition for normally forming a barrier between a detonator and an explosive train contained in said shell, a carrier comprising a cup-shaped bottom on the trailing end of a projectile and an inverted cup-shaped cover on the leading end thereof, said bottom and cover having coaxial central holes, a safing and arming stationary carrier block closely fitted between said bottom and cover and provided with an opening segment extending through less than 180 degrees of said bottom and cover so as to remain stationary therebetween, a radially movable barrier fitted in said opening and normally blocking said holes, said bottom having a cut out portion that is yieldable toward the trailing end as the result of setback which engages a notch at the bottom surface of said movable barrier, such that in response to a predetermined setback, said yieldable portion will unseat from said notch and allow said movable barrier to move radially outwardly as the result of spin; time delay means comprising knife means mounted on said carrier block, and fingers of soft material connected to said movable barrier and engageable with said knife means as the result of spin of said projectile so as to provide relatively slow cutting action, whereby upon complete cutting of said finger means, said movable barrier will reach the inner surface of said bottom and cover and thereby allow free communication, between said detonator and explosive train, through said central holes thus completing the arming process; and locking means comprising locking leaf spring means arranged to keep said movable barrier in its armed position.

11. Apparatus as recited in claim 10 together with spin detent resilient means normally engaging said movable barrier to restrain it from radial outward movement and being responsive to a predetermined spin sufficiently to disengage said movable barrier and allow free radial movement thereof.

12. Apparatus as recited in claim 11 in which said spin detent means comprises a substantially U-shaped resilient leaf spring with inwardly turned extremities which normally engage the outer surface of said movable barrier, which resilient leaf spring will disengage the movable barrier as a consequence of spin, said spring being fitted in a correspondingly shaped groove formed on top of said stationary carrier block.

13. Apparatus as recited in claim 12 wherein said fingers are of a material of the group consisting of lead, aluminum, tin and plastic, and are supported in grooves in said movable barrier.

* * * * *